US010358197B2

(12) United States Patent
Zhang

(10) Patent No.: US 10,358,197 B2
(45) Date of Patent: Jul. 23, 2019

(54) LIFESAVING ROPE APPARATUS, LIFE JACKET, AND WATER LIFESAVING DEVICE

(71) Applicant: BOE Technology Group Co., Ltd., Beijing (CN)

(72) Inventor: Yuanming Zhang, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 15/571,018

(22) PCT Filed: May 3, 2017

(86) PCT No.: PCT/CN2017/082880

§ 371 (c)(1),
(2) Date: Oct. 31, 2017

(87) PCT Pub. No.: WO2017/202182

PCT Pub. Date: Nov. 30, 2017

(65) Prior Publication Data

US 2018/0222558 A1 Aug. 9, 2018

(30) Foreign Application Priority Data

May 27, 2016 (CN) ..... 2016 1 0366290

(51) Int. Cl.
*B63C 9/26* (2006.01)
*B63C 9/20* (2006.01)
(Continued)

(52) U.S. Cl.
CPC ..... *B63C 9/26* (2013.01); *B63C 9/081* (2013.01); *B63C 9/1255* (2013.01); *B63C 9/20* (2013.01)

(58) Field of Classification Search
CPC ..... B63C 9/26; B63C 9/081; B63C 9/105; B63C 9/1255; B63C 9/18; B63C 9/20
See application file for complete search history.

(56) References Cited

U.S. PATENT DOCUMENTS 3,095,587 A 7/1963 Whalen
4,799,906 A * 1/1989 Perkins, Jr. ..... B63C 9/22 102/504
(Continued)

FOREIGN PATENT DOCUMENTS

CN 101628614 A 1/2010
CN 101678883 3/2010
(Continued)

OTHER PUBLICATIONS

Chinese Office Action for Chinese Application No. 201610366290.0 dated Feb. 24, 2018.
(Continued)

*Primary Examiner* — Stephen P Avila
(74) *Attorney, Agent, or Firm* — Fay Sharpe LLP

(57) ABSTRACT

The present disclosure provides a lifesaving rope rescue apparatus, a life jacket and a water lifesaving device to increase the probability of rescuing the drowning victim and reduce the difficulty of water rescue. The lifesaving rope apparatus comprises a rope and an ejection apparatus used to eject the rope and is used by a rescuer to rescue the victim over water.

18 Claims, 2 Drawing Sheets

(51) Int. Cl.
*B63C 9/08* (2006.01)
*B63C 9/125* (2006.01)

(56) References Cited

U.S. PATENT DOCUMENTS

| | | | | |
|---|---|---|---|---|
| 5,083,522 | A * | 1/1992 | Ashrow | A63B 69/12 114/215 |
| 6,257,942 | B1 * | 7/2001 | Groover | B63C 9/26 441/84 |
| 6,678,895 | B1 * | 1/2004 | Grilliot | A41D 13/0512 2/268 |
| 8,322,329 | B1 * | 12/2012 | Sikes | F41B 11/724 124/73 |
| 2009/0318042 | A1 * | 12/2009 | Huang | B63C 9/155 441/122 |
| 2013/0210296 | A1 * | 8/2013 | Bertsch | B63C 9/18 441/85 |
| 2014/0218217 | A1 * | 8/2014 | Calvar Anton | B63C 9/08 340/984 |

FOREIGN PATENT DOCUMENTS

| | | | |
|---|---|---|---|
| CN | 101678883 | A | 3/2010 |
| CN | 202557768 | U | 11/2012 |
| CN | 202728552 | | 2/2013 |
| CN | 202728552 | U | 2/2013 |
| CN | 203142996 | U | 8/2013 |
| CN | 203698629 | U | 7/2014 |
| CN | 203864966 | | 10/2014 |
| CN | 203864966 | U | 10/2014 |
| CN | 204223163 | U | 3/2015 |
| CN | 105416530 | | 3/2016 |
| CN | 105501410 | A | 4/2016 |
| CN | 105905263 | | 8/2016 |
| CN | 206050019 | | 3/2017 |
| CN | 206050019 | U | 3/2017 |
| GB | 2528898 | A | 2/2016 |
| WO | 2015162425 | | 10/2015 |
| WO | WO 2015/162425 | A1 | 10/2015 |

OTHER PUBLICATIONS

International Search Report in International Application No. PCT/CN2017/082880 dated Aug. 9, 2017.
Chinese Office Action for Chinese Application No. 201610366290.0 dated May 17, 2017.
Chinese Office Action for Chinese Application No. 201610366290.0 dated Sep. 30, 2017.

* cited by examiner

LIFESAVING ROPE APPARATUS, LIFE JACKET, AND WATER LIFESAVING DEVICE

CROSS-REFERENCE TO RELATED APPLICATION

This application is a U.S. national phase of International Application No. PCT/CN2017/082880, filed on May 3, 2017, which claims priority to Chinese Patent Application No. 201610366290.0, filed on May 27, 2016, both of which are incorporated herein by reference in their entireties.

TECHNICAL FIELD

Embodiments of the present disclosure relate to the technical field of life jackets, and more particularly to a lifesaving rope apparatus, a life jacket and a water lifesaving device.

BACKGROUND

Nowadays, more and more people participate in water activities, for example, people who participate in water leisure and entertainment activities in lake districts or along seashores, and fishermen who make a living from fishing. Where there are water activities, there is a potential threat to life. Therefore, people usually wear life jackets so that life jacket buoyancy can save people from danger when people accidently fall in water.

Nowadays, with the social development, there are more and more scenic places with water activities. Safety is the basic requirement. However, regular life jackets cannot be used flexibly, which makes water rescue not easy to conduct when a drowning incident happens.

SUMMARY

The embodiments of the present disclosure provide a lifesaving rope apparatus, a life jacket and a water lifesaving device to increase the probability of rescuing the drowning victim and to reduce the difficulty of water rescue.

The embodiments of the present disclosure provide a lifesaving rope apparatus, used by a rescuer to rescue a victim over water. The lifesaving rope apparatus comprises a rope and an ejection apparatus used to eject the rope.

The lifesaving rope apparatus provided in the embodiments of the present disclosure not only comprises the rope, but also comprises the ejection apparatus used to eject the rope. Thus, by means of ejecting out the rope of the lifesaving rope apparatus, a person nearby can rescue the victim (i.e., the drowning victim) timely, when a drowning incident happens. A rescuer who cannot swim can rescue the drowning victim over water by means of the lifesaving rope apparatus, thereby increasing the probability of rescuing the drowning victim and reducing the difficulty of water rescue.

In some embodiments, the ejection apparatus comprises one or any combination of following parts: a spiral spring, a flat spring, a deformed spring; or the ejection apparatus comprises an apparatus storing high pressure gas.

Thus, when a drowning incident happens, the drowning victim can manually activate the ejection apparatus. For example, the drowning victim can perform operations, such as flipping the spring, pulling and stretching the rope, or pressing the apparatus storing high pressure gas, to spray out the high pressure gas in order to drive the rope to eject out, thereby bringing the convenience for the person nearby to rescue the drowning victim.

In some embodiments, the ejection apparatus comprises a switch manually pressed by a user to activate the ejection apparatus.

In some embodiments, the ejection apparatus comprises a card slot for fixing the rope therein when the rope is not ejected.

Thus, it's more convenient for carrying and using the lifesaving rope apparatus.

In some embodiments, the rope comprises an interior layer structure in which the constituent material is water inflatable rubber and an exterior layer structure in which the constituent material is fiber.

Since the constituent material of the interior layer structure of the rope is water inflatable rubber, the rope can keep straight and the rope elongation rate can be reduced, which is convenient for the rescuer to rescue the victim. Meanwhile, since the constituent material of the exterior layer structure of the rope is fiber, the rope strength and strike resistance capability can be increased. In addition, since fiber is a light material, it makes rope float on water, which is convenient for the rescuer to rescue the victim.

In some embodiments, a rope head of the rope is fusiform.

Thus, the rope can be ejected towards a target direction more easily by means of the fusiform rope head.

In some embodiments, the rope head of the rope comprises a hard object wrapped with a soft material.

Thus, the probability of accidentally injuring people nearby or the rescuer in a crowded area can be reduced.

In some embodiments, an outer surface of the rope is coated with a fluorescent material or a self-luminescent material.

Thus, it helps the rescuer discern objects both in daytime and at night.

The embodiments of the present disclosure provide a life jacket. The life jacket comprises a lifesaving rope apparatus and a life jacket body, wherein the life jacket body is connected to the lifesaving rope apparatus.

The life jacket provided in the embodiments of the present disclosure includes not only the life jacket body, but also includes the lifesaving rope device connected to the life jacket body and used by the rescuer to rescue the victim. Therefore, rescuing the drowning victim becomes more convenient for the rescuer and even the rescuer who cannot swim is also able to rescue the victim over water by means of the lifesaving rope apparatus, thereby increasing the probability of rescuing the drowning victim and reducing the difficulty of water rescue.

In some embodiments, the life jacket further comprises a detector, wherein the detector is electrically connected to the ejection apparatus and used to send an activation command to the ejection apparatus when the lifejacket is detected to keep still on water surface for a preset period of time; and the ejection apparatus further comprises a controller, used to control the ejection apparatus to activate when the activation command sent from the detector is received.

Thus, when a drowning incident happens, the activation command sent from the detector can be received via the controller to automatically control the ejection apparatus to activate, which makes usage more flexible and makes it convenient for the rescuer to rescue the drowning victim on the water.

In some embodiments, the life jacket body comprises an air bag internally, the life jacket further comprises an air inflation apparatus used to inflate the air bag, and the air inflation apparatus is connected to the air bag.

Thus, the drowning victim can manually operate the air inflation apparatus to make it inflate the air bag, so that the life jacket body can float on water surface to increase the buoyancy of the drowning victim body to further hold the drowning victim's head out of the water, thereby bringing convenience for drowning victim to rescue himself.

In some embodiments, the life jacket further comprises a detector, wherein the detector is electrically connected to the air inflation apparatus and used to send an activation command to the air inflation apparatus when the life jacket is detected to keep still on water surface for a preset period of time; and the air inflation apparatus comprises a controller, used to control the air inflation apparatus to activate when the activation command sent from the detector is received.

Thus, when a drowning incident happens, by means of inflating the life jacket automatically, the buoyancy of the drowning victim body can be increased so that the head can be held out of the water, thereby increasing the probability of rescuing the drowning victim.

In some embodiments, the life jacket further comprises an alarm apparatus used to send out an alarm signal.

Thus, the attention of people nearby can be attracted so that the people nearby can rescue the drowning victim timely, thereby increasing the probability of rescuing the drowning victim.

In some embodiments, the life jacket further comprises a detector, wherein the detector is electrically connected to the alarm apparatus and used to send an activation command to the alarm apparatus when the life jacket is detected to keep still on water surface for a preset period of time; and the alarm apparatus comprises a controller, used to control the alarm apparatus to activate when the activation command sent from the detector is received.

Thus, an alarm can be issued toward outward automatically via the life jacket, thereby increasing the probability of rescuing the drowning victim.

In some embodiments, the alarm apparatus comprises a positioner used to determine current positional information of the life jacket and to send the positional information to an external electronic device.

Thus, ifs convenient for relatives and friends or people nearby to obtain the current positional information of the drowning victim timely, to rescue the drowning victim timely.

The life jacket body is watchband-shaped when it's not inflated and is for the victim to wear on the wrist.

Thus, it's more convenient to wear the life jacket body and more flexible for usage.

A water lifesaving device provided in the embodiments of the present disclosure, including the lifesaving rope apparatus mentioned above.

BRIEF DESCRIPTION OF THE DRAWINGS

To describe the technical solutions in the embodiments of the present disclosure or in the prior art more clearly, the following briefly introduces the accompanying drawings required for describing the embodiments. Apparently, the accompanying drawings in the following description show merely some embodiments of the present disclosure, and a person of ordinary skill in the art may still derive other drawings from these accompanying drawings without creative efforts.

DETAILED DESCRIPTION OF THE EMBODIMENTS

In the embodiments of the present disclosure, a lifesaving rope apparatus, a life jacket, and a water lifesaving device are provided to increase the probability to rescue the drowning victim and reduce the difficulty of water rescue.

Hereinafter, the technique solutions in the embodiments of the present disclosure will be described in a clear and detailed manner with reference to the drawings in the embodiments of the present disclosure. Apparently, the embodiments described hereinafter are merely some embodiments of the present disclosure, rather than all of the embodiments. Based on the embodiments of the present disclosure, all other embodiments derived by those skilled in the art without creative efforts fall into the protection scope of the present disclosure.

Figure 1:
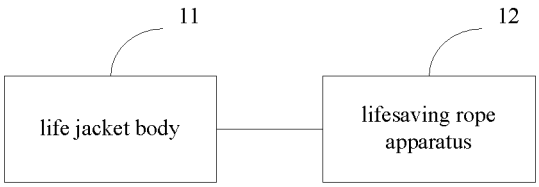
FIG. 1 is a structural diagram of a life jacket provided in an embodiment of the present disclosure.

Referring to FIG. 1, a life jacket provided in the embodiments of the present disclosure comprises a life jacket body 11 and a lifesaving rope apparatus 12 that is used by a rescuer to rescue the victim. The lifesaving rope apparatus 12 is connected to the life jacket body 11.

Thus, people who work on the water can wear the life jacket, and when a drowning incident happens, they can eject out a rope by means of the lifesaving rope device, so that people nearby can rescue the victim (i.e., the drowning victim) timely. Even the rescuer who cannot swim is also able to conduct water rescue for the victim through the lifesaving rope apparatus, which increases the probability of rescuing the drowning victim and reduces the difficulty of water rescue.

Figure 2:
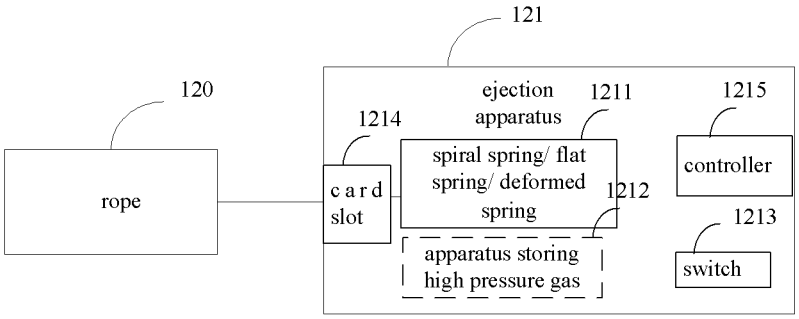
FIG. 2 is a structural diagram of a lifesaving rope apparatus provided in an embodiment of the present disclosure.

A schematic diagram for the structure of the lifesaving rope apparatus 12 is illustrated in FIG. 2. The lifesaving rope apparatus 12 comprises a rope 120 and an ejection apparatus 121 that is used to eject the rope out.

As an implementation, the ejection apparatus 121 can comprise one of the following parts or any combination of the following parts: a spiral spring, a flat spring, and a deformed spring 1211, to achieve ejection of the rope in the lifesaving rope apparatus 12.

As another implementation, the ejection apparatus 121 can comprise an apparatus 1212 storing high pressure gas.

The ejection apparatus 121 can comprise, for example, a switch 1213 to activate the ejection apparatus. When the ejection apparatus 121 comprises one of the following parts or any combination of the following parts: a spiral spring, a flat spring, a deformed spring, the switch can be, for example, one of the springs mentioned above or a switching part connected to any one of the springs mentioned above. The drowning victim can manually press the switch to activate the ejection apparatus, so that the rope can be ejected out. When the ejection apparatus 121 comprises the apparatus storing the high pressure gas, the switch can be, for example, a button or other part installed on the apparatus storing the high pressure gas. The drowning victim can manually press the switch to spray out the high pressure gas to drive the rope of the life-saving rope device to eject out.

In addition, the drowning victim can activate the ejection apparatus by pulling and stretching the rope. That is to say, the drowning victim can activate the ejection apparatus in many ways, which will not be limited in the embodiments of the present disclosure.

In some embodiments, the ejection apparatus 121 further comprises a card slot 1214 for fixing the rope therein when the rope is not ejected out.

In this way, it becomes more convenient to carry and use the life jacket.

In some embodiments, the rope 120 comprises a dual layer, i.e., interior layer and exterior layer, structure. The constituent material of the exterior layer structure is fiber and the constituent material of the interior layer structure is water inflatable rubber.

Since the constituent material of the interior layer structure of the rope 120 is water inflatable rubber, the rope can keep straight and the rope elongation rate can be reduced, which is convenient for the rescuer to rescue the victim. Meanwhile, since the constituent material of the exterior layer structure of the rope 120 is fiber, the rope strength and strike resistance can be increased. In addition, since fiber is a light material, it makes the rope float on water surface, to facilitate the rescue.

In some embodiments an outer surface of the rope 120 is coated with a fluorescent material or a self-luminescent material.

Thus, it helps the rescuer discern objects no matter in daytime or at night.

In some embodiments, the rope head of the rope 120 is fusiform.

Thus, the rope can be ejected towards the target direction more easily by means of the fusiform rope head.

In some embodiments, the rope head of the rope 120 comprises a hard object wrapped with a soft material. That is to say, the rope head 120 is made of a relatively hard material and the external part of the rope head is wrapped with a soft material, for example, foam or other soft materials.

The rope head is made of a hard object wrapped with a soft material and is fusiform in shape so that not only the rope 120 can be driven to eject towards the target direction but also the probability of injuring the people or the rescuer in the crowded area is reduced.

Figure 3:
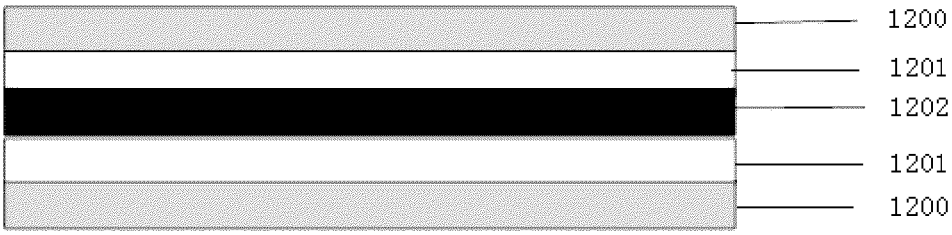
FIG. 3 is a sectional structural diagram of a rope in a lifesaving rope apparatus provided in an embodiment of the present disclosure.

A schematic diagram for a sectional structure of the rope in a lifesaving rope apparatus provided in the embodiments of the present disclosure is illustrated in FIG. 3.

In FIG. 3, the rope comprises: a fluorescent layer 1200, a fiber layer 1201, and a rubber layer 1202 in sequence from the exterior layer structure to the interior layer structure. Wherein, the fluorescent layer 1200 can be made of a fluorescent material or a self-luminescent material; the fiber layer 1201 is made of high-strength light fiber; the rubber layer 1202 is made of water inflatable rubber. The rope has high strength, low elongation rate, high strike resistance and is floatable on water. Since the constituent materials of the rope comprise water inflatable rubber, the rope can keep straight in water, which is convenient for the rescuer to rescue the victim. In addition, since the most exterior layer of the rope is the fluorescent layer, it helps the rescuer discern objects no matter in daytime or at night.

In some embodiments, the life jacket further comprises a detector. The detector is electrically connected to the ejection apparatus in the lifesaving rope apparatus 12 and is used to send an activation command to the ejection apparatus when the life jacket is detected to keep still on water surface for a preset period of time; and the ejection apparatus further comprises a controller 1215, used to control the ejection apparatus to activate when the activation command sent from the detector is received.

In some embodiments, after receiving the activation command sent from the detector, the ejection apparatus controls the rope by default to be ejected vertically upwards above water in order to prevent other people being injured by accident. Of course, the controller can also be set to control the rope to be ejected towards other directions.

Thus, when a drowning incident happens, even though the drowning victim does not manually activate the ejection apparatus in time, the detector can perform a detection and send the activation command to the ejection apparatus so that the ejection apparatus can be activated automatically by the controller to eject out the rope after the ejection apparatus receives the activation command sent by the detector, which helps the rescuer rescue the drowning victim over water.

It is necessary to explain that a real drowning victim will not move randomly in the water because at that moment water enters the victim's lung. Generally speaking, a drowning victim will die of suffocation when the victim keeps still in the water for 30 seconds. Therefore, the detector determines whether the person wearing life jacket is involved in the drowning incident by detecting whether the life jacket is still on the water surface. In addition, when the detector detects that the life jacket has kept still in the water for a preset period of time, it will send the activation command to the ejection apparatus. The preset period of time should be shorter than the suffocation time period that causes drowning victim to die. Assuming the suffocation time period causing the drowning victim to die is 30 seconds, the preset period of time, for example, can be set as 15 seconds and so forth so that the drowning victim can be rescued in time.

As an alternative embodiment, the life jacket body 11 comprises an air bag internally, the life jacket further comprises an air inflation apparatus 13 used to inflate the air bag, and the air inflation apparatus is connected to the air bag.

Wherein, the air inflation apparatus can be, for example, a high pressure gas steel cylinder to inflate the air bag faster. Of course, the air inflation apparatus can also be other devices, for example, a device filled with carbon dioxide, which will not be limited by the embodiments of the present disclosure.

In some embodiments, the life jacket further comprises a detector. The detector is electrically connected to the air inflation apparatus and is used to send an activation command to the air inflation apparatus when the life jacket is detected to keep still on water surface for a preset period of time; and the air inflation apparatus comprises a controller, which is used to control the air inflation apparatus to activate when the activation command sent from the detector is received.

Clearly, the life jacket provided in the embodiments of the present disclosure is more flexible to use and can be inflated automatically. When the controller in the air inflation apparatus receives the activation command sent from the detector, it can be determined that the drowning incident has happened and thus the air inflation apparatus can be controlled to start the inflation process to hold the drowning victim's head out of the water through the buoyancy. Of course, the drowning victim can also activate the air inflation apparatus manually under certain circumstance to inflate the air bag of the life jacket body by means of the air inflation apparatus.

It is necessary to explain that the detector that sends the activation command to the air inflation apparatus and the detector that sends the activation command to the ejection apparatus can be the same one or different ones, which will not be limited in the embodiments of the present disclosure.

In an alternative embodiments, the life jacket mentioned above further comprises an alarm apparatus 14 used to send out an alarm signal.

Wherein, when a drowning incident happens, the drowning victim can manually press the alarm apparatus 14 to send out the alarm signal to attract the attention of the people nearby so that the people nearby can rescue the drowning victim in time, thereby increasing the probability of rescuing the drowning victim. The alarm signal can be making sounds, for example, whistles, etc. or broadcasting a drowning notification or the like, to attract the nearby rescuers' attention or ordinary people's attention.

In some embodiments, the life jacket further includes a detector. The detector is electrically connected to the alarm apparatus and is used to send an activation command to the alarm apparatus when the life jacket is detected to keep still on water surface for a preset period of time; and the alarm apparatus comprises a controller, which is used to control the alarm apparatus to activate when the activation command sent from the detector is received.

Thus, the life jacket detects whether a drowning incident happens through the detector and the detector sends the activation command to the alarm apparatus when it's determined that the drowning incident is happening (that means that the life jacket have kept still on the water surface for the preset period of time). After receiving the activation command sent from the detector, the alarm apparatus controls the alarm apparatus to activate automatically to attract the attention of the people nearby in time, thereby increasing the probability of rescuing the drowning victim.

It is necessary to explain that the detector that sends the activation command to the alarm apparatus and the detectors that sends the activation commands to the ejection apparatus and to the inflation apparatus can be the same one; or they can be three different detectors; or they can be two different detectors, wherein one detector sends the activation commands to any two of the ejection apparatus, the air inflation apparatus, and the alarm apparatus and the other one sends the activation command to the rest one device, which will not be limited in the embodiments of the present disclosure.

In some embodiments, the alarm apparatus comprises a positioner 141 used to determine current positional information of the life jacket and to send the positional information to an external electronic device. Wherein, the positioner can position the location via the Global Positioning System (GPS) etc.

Thus, it helps the relatives, friends, or people nearby obtain the current positional information of the drowning victim so that they can rescue the drowning victim in time.

In some embodiments, the life jacket body is watchband-shaped when it's not inflated and is for the victim to wear on the wrist.

Thus, the life jacket body is easier to wear and more flexible to use. Of course, the life jacket body can also be of a regular shape for the victim to wear on his/her body, or of other shapes for the victim to wear on other parts of his/her body, which will not be limited in the embodiments of the present disclosure.

Figure 4:
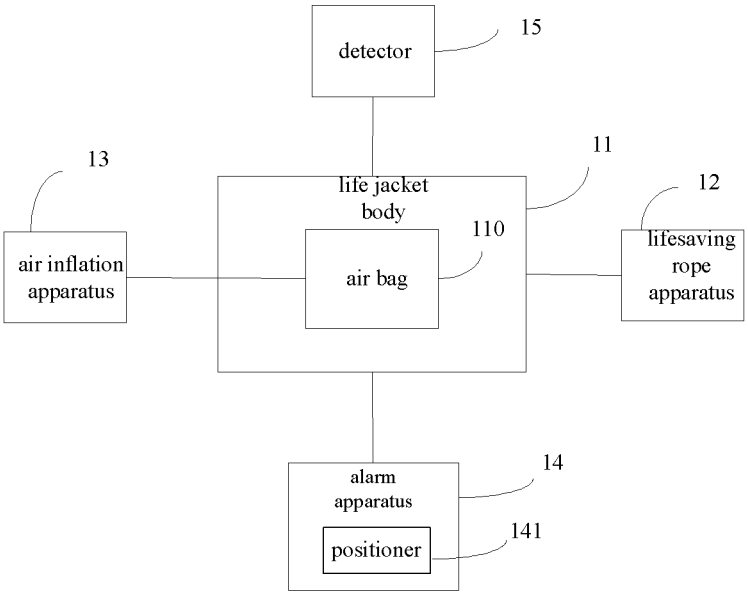
FIG. 4 is a structural diagram of another life jacket provided in an embodiment of the present disclosure.

As an alternative embodiment, the structure of another life jacket provided in the embodiment of the present disclosure is illustrated in FIG. 4. The life jacket comprises the life jacket body 11, the lifesaving rope apparatus 12 installed on the life jacket body 11, the inflation apparatus 13, the alarm apparatus 14, and a detector 15. Wherein, an air bag 110 is provided inside the life jacket body 11 and is connected to the air inflation apparatus 13. In addition, the detector 15 is connected to the lifesaving rope apparatus 12, the air inflation apparatus 13, and the alarm apparatus 14 respectively. Each of the lifesaving rope apparatus 12, the air inflation apparatus 13, and the alarm apparatus 14 has a controller that is used to control its corresponding device to activate after receiving the activation command sent from the detector.

By wearing the life jacket shown in FIG. 4, when the drowning incident happens to people who work on the water, the detector 15 sends the activation command to the controller in the air inflation apparatus 13 and the air inflation apparatus 13 starts inflating the life jacket at that moment so that the buoyancy can hold the drowning victim's head out of the water. Meanwhile, the detector 15 sends the activation command to the controller in the alarm apparatus 14 and the alarm apparatus 14 starts sending out the alarm signal at that moment to attract the attention of the people nearby. Meanwhile, the detector 15 sends the activation command to the lifesaving rope apparatus 12 and the lifesaving rope apparatus 12 ejects the rope towards the preset target direction to facilitate rescue of the drowning victim by people nearby.

It is necessary to explain that the detector 15 in the present embodiment sends the activation command to the lifesaving rope apparatus 12, the air inflation apparatus 13, and the alarm apparatus 14 simultaneously. Of course, the detector 15 can also send the activation command to the lifesaving rope apparatus 12, the air inflation apparatus 13, and the alarm apparatus 14 respectively at different times. In addition, the drowning victim can also choose to manually activate the related devices (including the lifesaving rope apparatus 12, the air inflation apparatus 13, and the alarm apparatus 14) when the devices are not activated, in accordance with the actual needs.

In addition, it is understandable that as an alternative embodiment, the life jacket can comprise the life jacket body 11, the lifesaving rope apparatus 12, the air inflation apparatus 13, and the alarm apparatus 14 as shown in FIG. 4 simultaneously. Of course, the life jacket can also comprise only one or any combination of the devices mentioned above.

Figure 5:
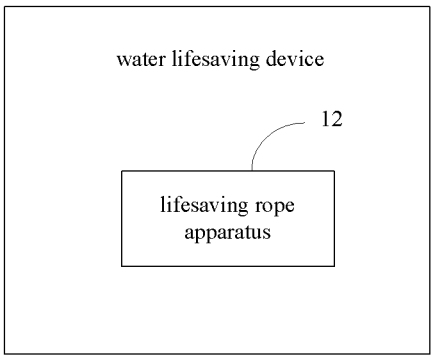
FIG. 5 is a water lifesaving device provided in an embodiment of the present disclosure.

As shown in FIG. 5, the embodiments of the present disclosure further provide a water lifesaving device comprising the lifesaving rope apparatus 12 mentioned above. Wherein, the water lifesaving device, can be, for example, a ring buoy, a life jacket, a lifeboat, a life float, a life raft, etc.

Apparently, any adaptations and variations of the present disclosure may be made by a person skilled in the art without departing from the spirit and scope of the present disclosure. The present disclosure is intend to cover any modifications and variations if they fall into the protection scope of the claims of the present disclosure and its equivalent techniques.

What is claimed is:

1. A life jacket, comprising a lifesaving rope apparatus and a life jacket body, wherein the life jacket body is connected to the lifesaving rope apparatus; and the lifesaving rope apparatus comprises a rope and an ejection apparatus configured to eject the rope; and the life jacket further comprises either:

(A) a detector and a controller within the ejection apparatus, wherein the detector is electrically connected to the ejection apparatus and is configured to send an activation command to the ejection apparatus when the life jacket is still on water surface for a preset period of time, and the controller of the ejection apparatus is configured to control the ejection apparatus to activate when the activation command sent from the life jacket body is received; or (B) an air bag within the life jacket body, an air inflation apparatus connected to the air bag and configured to inflate the air bag and comprising a controller, a detector electrically connected to the air inflation apparatus and configured to send an activation command to the air inflation apparatus when the life jacket is still on water surface for a preset period of time, wherein the controller is configured to control the air inflation apparatus to activate when the activation command sent from the detector is received; or (C) a detector electrically connected to an alarm apparatus and configured to send an activation command to the alarm apparatus when the life jacket is still on water surface for a preset period of time, and an alarm apparatus configured to send out an alarm signal outwards and comprising a controller configured to control the alarm apparatus to activate when the activation command sent from the detector is received.

2. The life jacket of claim 1, wherein the alarm apparatus comprises a positioner configured to determine current positional information of the life jacket and to send the positional information to an external electronic device.

3. The life jacket of claim 1, wherein the life jacket body is watchband-shaped when it is not inflated and is configured to be worn on a wrist of the victim.

4. A water lifesaving device, comprising a lifesaving rope apparatus and a lifesaving device body, wherein the lifesaving device body is connected to the lifesaving rope apparatus, wherein the lifesaving rope apparatus comprises a rope and an ejection apparatus configured to eject the rope, and the water lifesaving device further comprises either:

(A) a detector and a controller within the ejection apparatus, wherein the detector is electrically connected to the ejection apparatus and is configured to send an activation command to the ejection apparatus when the water lifesaving device is still on water surface for a preset period of time, and the controller of the ejection apparatus is configured to control the ejection apparatus to activate when the activation command sent from the detector is received; or (B) an air bag within the water lifesaving device body, an air inflation apparatus connected to the air bag and configured to inflate the air bag and comprising a controller, a detector electrically connected to the air inflation apparatus and configured to send an activation command to the air inflation apparatus when the water lifesaving device is still on water surface for a preset period of time, wherein the controller is configured to control the air inflation apparatus to activate when the activation command sent from the detector is received; or (C) a detector electrically connected to an alarm apparatus and configured to send an activation command to the alarm apparatus when the water lifesaving device is still on water surface for a preset period of time, and an alarm apparatus configured to send out an alarm signal outwards and comprising a controller configured to control the alarm apparatus to activate when the activation command sent from the detector is received.

5. The life jacket of claim 1, wherein the ejection apparatus comprises one or any combination of following parts: a spiral spring, a flat spring, or a deformed spring; or the ejection apparatus comprises an apparatus storing high pressure gas.

6. The life jacket of claim 1, wherein the ejection apparatus comprises a switch configured to be manually pressed by a user to activate the ejection apparatus.

7. The life jacket of claim 1, wherein the ejection apparatus comprises a card slot configured to fix the rope therein when the rope is not ejected out.

8. The life jacket of claim 1, wherein the rope comprises an interior layer structure comprising water inflatable rubber and an exterior layer structure comprising fiber.

9. The life jacket of claim 1, wherein a rope head of the rope is fusiform.

10. The life jacket of claim 1, wherein a rope head of the rope comprises a hard object wrapped with a soft material.

11. The life jacket of claim 1, wherein an outer surface of the rope is coated with a fluorescent material or a self-luminescent material.

12. The water lifesaving device of claim 4, wherein the ejection apparatus comprises one or any combination of following parts: a spiral spring, a flat spring, or a deformed spring; or the ejection apparatus comprises an apparatus storing high pressure gas.

13. The water lifesaving device of claim 4, wherein the ejection apparatus comprises a switch configured to be manually pressed by a user to activate the ejection apparatus.

14. The water lifesaving device of claim 4, wherein the ejection apparatus comprises a card slot configured to fix the rope therein when the rope is not ejected out.

15. The water lifesaving device of claim 4, wherein the rope comprises an interior layer structure comprising water inflatable rubber and an exterior layer structure comprising fiber.

16. The water lifesaving device of claim 4, wherein a rope head of the rope is fusiform.

17. The water lifesaving device of claim 4, wherein a rope head of the rope comprises a hard object wrapped with a soft material.

18. The water lifesaving device of claim 4, wherein an outer surface of the rope is coated with a fluorescent material or a self-luminescent material.

* * * * *